US006674336B2

(12) United States Patent
Isoda

(10) Patent No.: US 6,674,336 B2
(45) Date of Patent: Jan. 6, 2004

(54) NON-RECIPROCAL CIRCUIT ELEMENT AND COMMUNICATION DEVICE

(75) Inventor: Junpei Isoda, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/122,037

(22) Filed: Apr. 11, 2002

(65) Prior Publication Data

US 2002/0149438 A1 Oct. 17, 2002

(30) Foreign Application Priority Data

Apr. 13, 2001 (JP) ..... 2001-115496

(51) Int. Cl.[7] ..... H01P 1/32
(52) U.S. Cl. ..... 333/1.1; 333/24.2
(58) Field of Search ..... 333/1.1, 24.2; 361/321.1, 306.1, 306.3

(56) References Cited

U.S. PATENT DOCUMENTS 6,020,793 A * 2/2000 Makino et al. ..... 333/1.1
6,043,973 A * 3/2000 Nagashima et al. ..... 361/305

FOREIGN PATENT DOCUMENTS

| | | |
|---|---|---|
| JP | 1-33929 | 7/1989 |
| JP | 8-148374 | 6/1996 |
| JP | 9-246087 | 9/1997 |
| JP | 10-12484 | 1/1998 |
| JP | 10-149943 | 6/1998 |
| JP | 11-186814 | 7/1999 |
| JP | 2000-353931 | 12/2000 |
| JP | 2000-353933 | 12/2000 |

* cited by examiner

*Primary Examiner*—Terry D. Cunningham
*Assistant Examiner*—Quan Tra
(74) *Attorney, Agent, or Firm*—Keating & Bennett, LLP

(57) ABSTRACT

A non-reciprocal circuit element has matching capacitors, each disposed between an I/O port and ground. Each matching capacitor has a dielectric substrate and first buffer layers, second buffer layers, and main lead layers formed on both surfaces of the dielectric substrate by dry thin-film deposition, in that order. For example, a Ni—Cr alloy, a Ni—Cu alloy, and Ag are used for the first buffer layers, the second buffer layers, and the main lead layers, respectively. The matching capacitors can solve the problems arising from the electrodes of known capacitors, and thus the non-reciprocal circuit element and communication devices using the capacitors can have excellent electrical characteristics.

13 Claims, 3 Drawing Sheets

NON-RECIPROCAL CIRCUIT ELEMENT AND COMMUNICATION DEVICE

BACKGROUND OF THE INVENTION

1. Field of the Invention

The present invention relates to non-reciprocal circuit elements, such as isolators and circulators used in the microwave band, and to communication devices comprising the same.

2. Description of the Related Art

A known lumped-constant isolator, or non-reciprocal circuit element, used for mobile communication devices such as cellular phones generally comprises a center electrode assembly, a magnet, a yoke, a resistor, and matching capacitors. The matching capacitors generally have Ag electrodes disposed on both surfaces of a dielectric substrate, as disclosed in Japanese Unexamined Patent Application Publication No. 11-186814.

The Ag electrodes are formed by screen-printing Ag paste so as to have a large thickness of 10 to 30 $\mu$m, and then by firing the printed paste at 850° C.

However, a burr or a crack may occur in the electrodes of the known capacitor when the capacitor is cut out. In other words, dicing the capacitor inevitably causes a burr in the thick electrodes, which can lead to several problems.

For example, the burr may cause the capacitance to be too low. Also, the burr effectively changes the size of the capacitor, which may prevent it from fitting accurately into a non-reciprocal device such as an isolator or circulator. Further, the burr may touch another capacitor or another conductor, causing a short circuit.

Moreover, a thick electrode, especially one made of metal, is soft and malleable. Thus, the thick electrodes readily cause clogging in the dicing blade and thus make the blade blunt. Furthermore, frit contained in the Ag paste remains after firing and adversely affects solder wettability.

In contrast, a dielectric ceramic substrate comprised in a capacitor is hard but brittle and fragile. Thus, it is difficult to select a dicing blade which will prevent cracking the substrate while avoiding the above problems of the electrodes, since the substrate and the electrodes respond so differently to the cutting operation.

SUMMARY OF THE INVENTION

Accordingly, the present invention provides a non-reciprocal circuit element comprising matching capacitors which are less susceptible to the problems described above, and provides a communication device comprising the non-reciprocal circuit element.

To this end, according to one aspect of the present invention, there is provided a non-reciprocal circuit element comprising matching capacitors. Each matching capacitor is disposed between an I/O port and ground, and comprises a dielectric substrate. First buffer layers, second buffer layers, and main lead layers are formed on both surfaces of the dielectric substrate by dry thin-film deposition, in that order. The first buffer layers are formed of a material which adheres to the dielectric substrate. The second buffer layers are formed of a material capable of preventing solder from diffusing into the dielectric substrate. The main lead layers are formed of a solderable conductive material.

The first buffer layers, the second buffer layers, and the main lead layers may be formed of various materials as long as the materials are capable of being used in dry thin-film deposition, such as sputtering, vapor deposition, thermal spraying, or ion plating. The first buffer layers may be formed of Ti, W, Ta, and Cr, and preferably a Ni—Cr alloy. The second buffer layers may be formed of Ni—Ag, Ni—Au, Ni—Ti, and alloys of the materials of the first buffer layers and the main lead layers, and preferably a Ni—Cu alloy. The main lead layers may be formed of Cu and Au, and preferably Ag.

In this non-reciprocal circuit element, the matching capacitor has thin electrodes, that is, the first buffer layers, the second buffer layers and the main lead layers, and therefore it can be readily diced while preventing burrs and cracks. Also, since the electrodes of the matching capacitor are formed of suitable materials, the capacitor has excellent electrical characteristics, consequently allowing a non-reciprocal circuit element to have improved electrical characteristics. Since the electrodes are formed by dry thin-film deposition, the electrodes do not contain frit and thus solder wettability is improved. In addition, since the electrodes are formed by dry thin-film deposition, small amounts of materials can be used for the electrodes and the firing process of the electrodes can be eliminated.

According to another aspect of the invention, a capacitor having the above-described features is provided.

In a further aspect of the present invention, a communication device comprising the non-reciprocal circuit element is provided and the communication device shows preferred electrical characteristics.

Other features and advantages of the present invention will become apparent from the following description of embodiments of the invention which refers to the accompanying drawings.

DESCRIPTION OF EMBODIMENTS OF THE INVENTION

A non-reciprocal circuit element and a communication device according to embodiments of the present invention will now be described with reference to the drawings.

(Non-Reciprocal Circuit Element)

Figure 1:
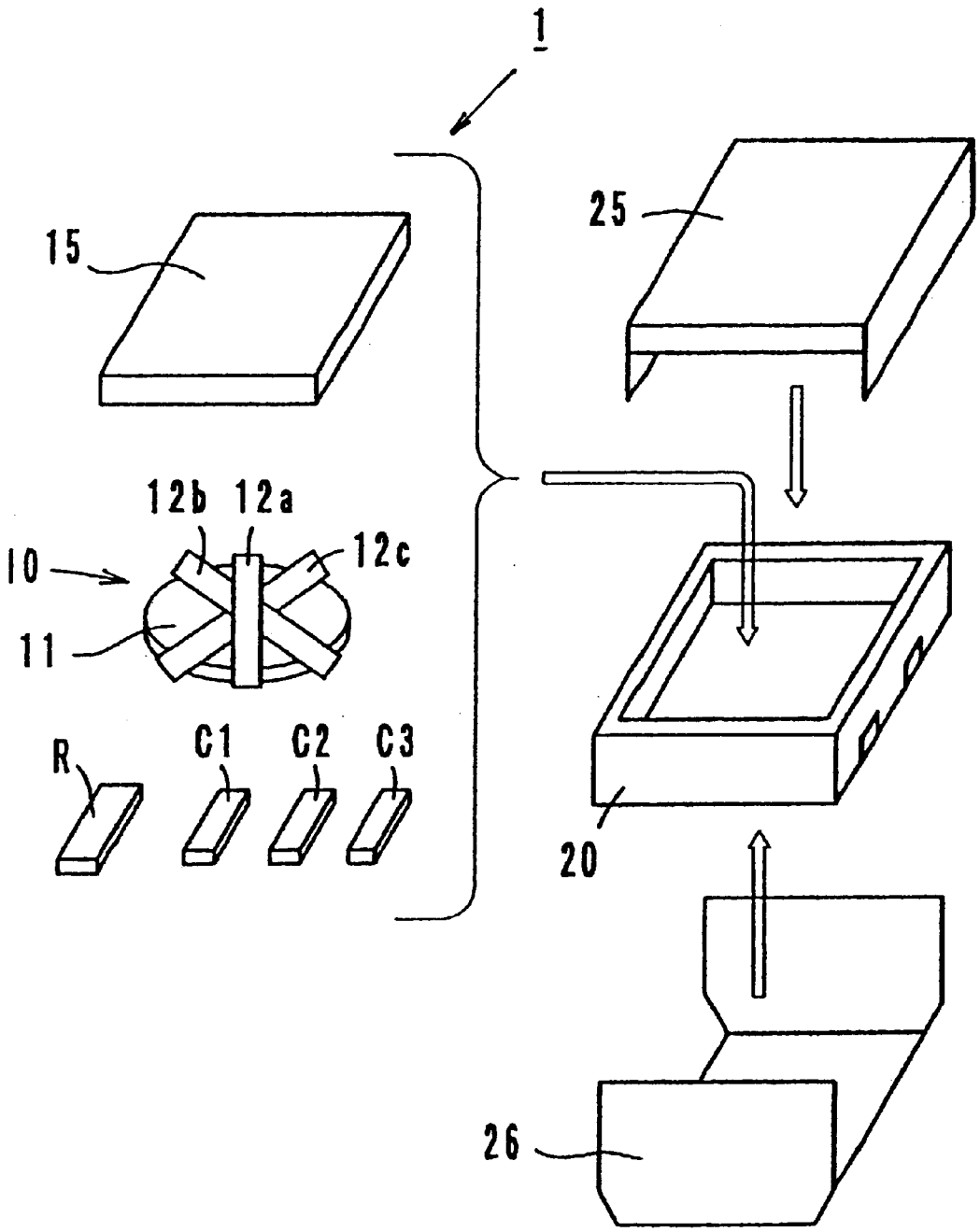
FIG. 1 is an exploded perspective view of a non-reciprocal circuit element according to an embodiment of the present invention.
Figure 2:
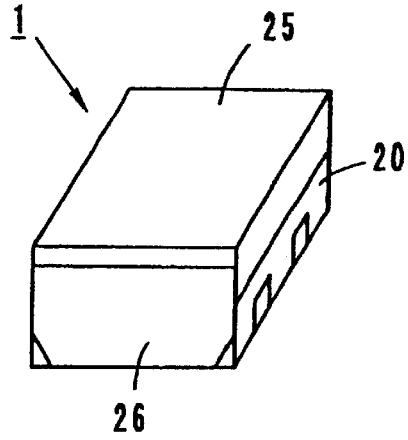
FIG. 2 is a perspective view of the exterior of the non-reciprocal circuit element.
Figure 3:
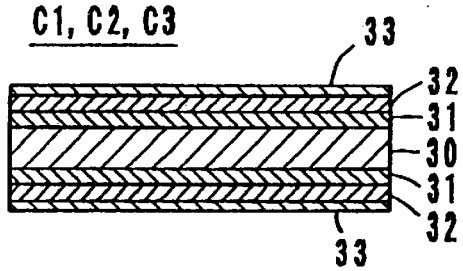
FIG. 3 is a sectional view of a matching capacitor contained in the non-reciprocal circuit element.

FIGS. 1 to 4 show a non-reciprocal circuit element 1 according to an embodiment of the present invention. FIG. 1 is a drawing showing components of the non-reciprocal circuit element 1 and FIG. 2 is an external view of the non-reciprocal circuit element 1 assembled from the components.

The non-reciprocal circuit element 1 is intended to serve as a lumped-constant isolator and comprises a center electrode assembly 10. The center electrode assembly 10 comprises three center electrodes 12*a*, 12*b*, and 12*c* provided on a microwave ferrite 11. The non-reciprocal circuit element 1 also comprises a magnet 15, a resistor R, and matching capacitors C1, C2, and C3. These components are incorporated into a base 20. The base 20 is covered with a cover 25 and a yoke 26.

Figure 4:
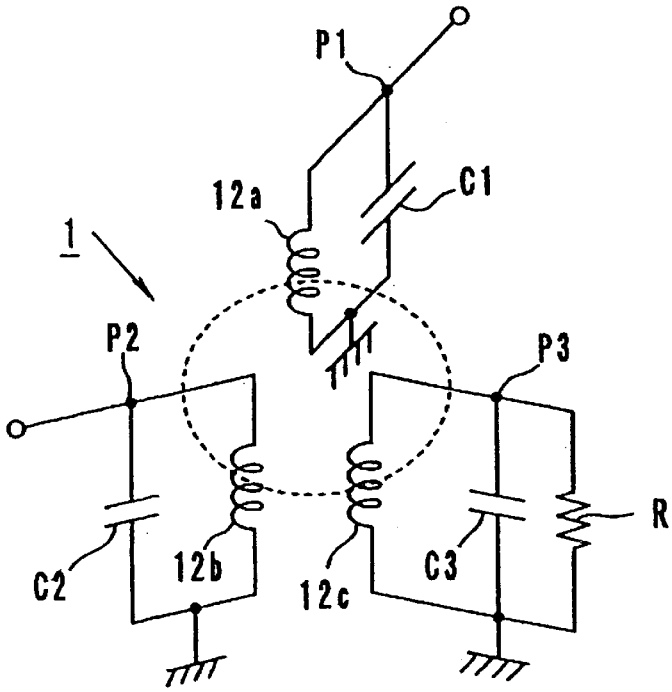
FIG. 4 is an equivalent circuit of the non-reciprocal circuit element.

All the components but the matching capacitors C1, C2 and C3 are conventionally known. As shown in FIG. 4, first ends of the center electrodes 12*a*, 12*b*, and 12*c* serve as corresponding I/O ports P1, P2, and P3, and the other ends of the center electrodes are grounded. The hot sides of the matching capacitors C1, C2, and C3 are soldered to the ports P1, P2, and P3, respectively. The cold sides of the capacitors are soldered to the grounded sides of the center electrodes.

One end of the resistor R is connected to the hot side of the matching capacitor C3, and the other end is connected to the grounded side of the center electrode 12*c*. Hence, the matching capacitor C3 and the resistor R are connected in parallel between the port P3 and the grounded side of the center electrode 12*c*.

(Matching Capacitors)

The matching capacitors comprise first buffer layers 31, second buffer layers 32, and main lead layers 33 formed on both surfaces of a ceramic dielectric substrate 30 in that order by dry thin-film deposition, such as sputtering, vapor deposition, thermal spraying, or ion plating.

The first buffer layers 31 are formed of a material which adheres to the dielectric substrate 30, such as Ni—Cr, Ti, W, Ta, or Cr. In this embodiment, the first buffer layers 31 are formed of Ni—Cr by sputtering so as to have a thickness of 0.18 $\mu$m. The second buffer layers 32 are formed of a material capable of preventing solder from diffusing into the dielectric substrate 30, such as Ni—Cu, Ni—Ag, Ni—Au, Ni—Ti, or an alloy of the materials of the first buffer layers 31 and the main lead layers 33. In this embodiment, the second buffer layers 32 are formed of Ni—Cu by sputtering so as to have a thickness of 0.18 $\mu$m. The main lead layers 33 are formed of a solderable conductive material, such as Ag, Cu, or Au. In this embodiment, the main lead layers are formed of Ag by sputtering so as to have a thickness of 0.8 $\mu$m.

Thus, the matching capacitor according to the structure described above has thin-film electrodes, that is, the first buffer layers 31, the second buffer layers 32, and the main lead layers 33, and therefore it can be readily diced while preventing burrs and cracks. Also, since a blade can be selected in view of only the characteristics of the dielectric substrate 30, clogging is rarely caused in the blade. In addition, the first buffer layers 31 improve the adherence to the substrate 30, the second buffer layers 32 prevent the diffusion of solder, and the main lead layers 33 improve solderability. Furthermore, the electrodes of the capacitor, which do not contain frit, contribute to the improvement of solder wettability.

The matching capacitors do not necessarily have a three-electrode structure, and may have another layer or a sputtered composite layer formed of a plurality of layers.

(Communication Device)

Figure 5:
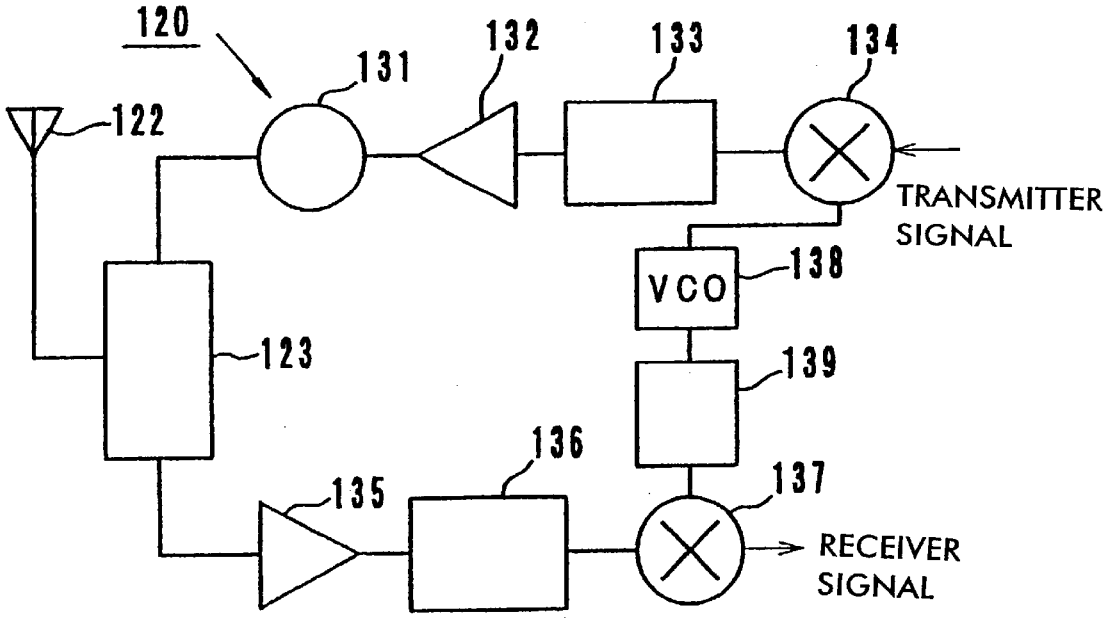
FIG. 5 is a block diagram showing an electrical circuit of a communication device (a cellular phone) according to the present invention.

An exemplary communication device according to the present invention will now be described with reference to FIG. 5. FIG. 5 shows a radio-frequency circuit (RF circuit) 120 of a cellular phone. The RF circuit 120 comprises an antenna element 122, a duplexer 123, a transmission isolator 131, a transmission amplifier 132, a transmission interstage band-pass filter 133, a transmission mixer 134, a reception amplifier 135, a reception interstage band-pass filter 136, a reception mixer 137, a voltage-controlled oscillator (VCO) 138, and a local band-pass filter 139.

The non-reciprocal circuit element 1, or lumped-constant isolator, is used as the transmission isolator 131. By using the non-reciprocal circuit element 1, the cellular phone can have excellent electrical characteristics.

However, the non-reciprocal circuit element and the communication device are not limited to the structure of the embodiments described above, but may undergo various changes and modifications without departing from the spirit and scope of the present invention.

In particular, components of the non-reciprocal circuit element, including the center electrode assembly, the magnet, and the base, may have any desired shape and structure.

According to the present invention, the electrodes of the matching capacitor are formed by dry thin-film deposition. Thus, the resulting matching capacitor can have thin electrodes, that is, the first buffer layers, the second buffer layers, and the main lead layers, and therefore it can be readily diced while preventing burrs and cracks. Also, since the electrodes of the matching capacitor are formed of suitable materials, the capacitor has excellent electrical characteristics, consequently allowing a non-reciprocal circuit element to have improved electrical characteristics. Since the electrodes are formed by dry thin-film deposition, the electrodes do not contain frit and thus solder wettability is improved. In addition, since the electrodes are formed by dry thin-film deposition, small amounts of materials can be used for the electrodes and the firing process of the electrodes can be eliminated.

By using the non-reciprocal circuit element, a communication device having excellent electrical characteristics can be achieved.

Although the present invention has been described in relation to particular embodiments thereof, many other variations and modifications and other uses will become apparent to those skilled in the art. Therefore, the present invention is not limited by the specific disclosure herein.

What is claimed is:

1. A non-reciprocal circuit element comprising:

a ferrite body; a magnet providing a magnetic field to said ferrite body;

a plurality of center electrodes disposed on said ferrite body, each of said center electrodes having an I/O port at one end and another end connected to a around electrode;

matching capacitors, each disposed between one of said P0 ports and said around electrode, each matching capacitor comprising a dielectric substrate with two opposed main surfaces, and first buffer layers, second buffer layers, and main lead layers, in that order, formed on both of said main surfaces of the dielectric substrate, said avers being thin-film layers; wherein the first buffer layers are formed of a material which adheres to the dielectric substrate, the second buffer avers are formed of a material capable of preventing solder from diffusing into the dielectric substrate, and the main lead layers are formed of a solderable conductive material; and the second buffer layers are formed of a material selected from the group consisting of Ni—Cu, Ni—Ag, Ni—Au, Ni—Ti, alloys thereof, and alloys of the materials of the first buffer layers and the main lead layers.

2. The non-reciprocal circuit element according to claim 1, wherein the first buffer layers are formed of a Ni—Cr alloy, the second buffer layers are formed of a Ni—Cu alloy, and the main lead layers are formed of Ag.

3. The non-reciprocal circuit element according to claim 1, wherein the first buffer layers are formed of a material selected from the group consisting of Ni—Cr, Ti, W, Ta and Cr and alloys thereof.

4. The non-reciprocal circuit element according to claim 1, wherein the main lead layers are formed of a material selected from the group consisting of Ag, Cu and Au.

5. A communication device comprising the non-reciprocal, circuit element according to claim 2 or 1.

6. A matching capacitor for a non-reciprocal circuit element, comprising:

a dielectric substrate with two opposed main surfaces, and first buffer layers, second buffer layers, and main lead layers, in that order, formed on both of said main surfaces of the dielectric substrate, said avers being thin-film layers; wherein the first buffer layers are formed of a material which adheres to the dielectric substrate, the second buffer layers are formed of a material capable of preventing solder from diffusing into the dielectric substrate, and the main lead layers are formed of a solderable conductive material; and the second buffer layers are formed of a material selected from the group consisting of Ni—Cu, Ni—Ag, Ni—Au, Ni—Ti, alloys thereof, and alloys of the materials of the first buffer layers and the main lead layers.

7. The non-reciprocal circuit element according to claim 6, wherein the first buffer layers are formed of a Ni—Cr alloy, the second buffer layers are formed of a Ni—Cu alloy, and the main lead layers are formed of Ag.

8. The non-reciprocal circuit element according to claim 6, wherein the first buffer layers are formed of a material selected from the group consisting of Ni—Cr, Ti, W, Ta and Cr and alloys thereof.

9. The non-reciprocal circuit element according to claim 6, wherein the main lead layers are formed of a material selected from the group consisting of Ag, Cu and Au.

10. A method of manufacturing a matching capacitor for a non-reciprocal circuit element, comprising the steps of:

providing a dielectric substrate having two opposed main surfaces, and forming first buffer layers, second buffer layers, and main lead layers, in that order, on both surfaces of the dielectric substrate, by dry thin-film deposition; wherein p1 the first buffer layers are formed of a material which adheres to the dielectric substrate, the second buffer layers are formed of a material capable of preventing solder from diffusing into the dielectric substrate, and the main lead layers are formed of a solderable conductive material; and the second buffer layers are formed of a material selected from the group consisting of Ni—Cu, Ni—Ag, Ni—Au, Ni—Ti, alloys thereof, and alloys of the materials of the first buffer layers and the main lead layers.

11. The method according to claim 10, wherein the first buffer layers are formed of a Ni—Cr alloy, the second buffer layers are formed of a Ni—Cu alloy, and the main lead layers are formed of Ag.

12. The method according to claim 10, wherein the first buffer layers are formed of a material selected from the group consisting of Ni—Cr, Ti, W, Ta and Cr and alloys thereof.

13. The method according to claim 10, wherein the main lead layers are formed of a material selected from the group consisting of Ag, Cu and Au.

* * * * *